United States Patent [19]

Lahti

[11] Patent Number: 4,760,510

[45] Date of Patent: Jul. 26, 1988

[54] SIMPLE MOUNTING FOR ELECTRICAL FIXTURE

[76] Inventor: Uolevi L. Lahti, 428 Fort Denaud Rd., LaBelle, Fla. 33935

[21] Appl. No.: 50,440

[22] Filed: May 18, 1987

[51] Int. Cl.[4] ..... F21V 21/02

[52] U.S. Cl. ..... 362/365; 362/148

[58] Field of Search ..... 362/148, 150, 364, 365

[56] References Cited

U.S. PATENT DOCUMENTS

| | | | |
|---|---|---|---|
| 2,997,575 | 8/1961 | Schwartz . | |
| 3,293,428 | 12/1966 | Herman . | |
| 3,912,865 | 10/1975 | Seebinger | 179/1 E |
| 4,399,497 | 8/1983 | Druffel | 362/362 |
| 4,471,416 | 9/1984 | Druffel | 362/430 |
| 4,566,057 | 1/1986 | Druffel | 362/364 |

FOREIGN PATENT DOCUMENTS

| | | | |
|---|---|---|---|
| 253441 | 2/1964 | Australia | 362/365 |
| 0726316 | 3/1955 | United Kingdom | 362/365 |
| 1216724 | 11/1959 | France | 362/365 |
| 1268272 | 6/1961 | France | 362/365 |
| 1283929 | 1/1962 | France | 362/365 |
| 1288739 | 2/1962 | France | 362/365 |
| 1304849 | 8/1962 | France | 362/365 |
| 1311290 | 10/1962 | France | 362/365 |

*Primary Examiner*—Willis R. Wolfe
*Assistant Examiner*—Eric R. Carlberg
*Attorney, Agent, or Firm*—Pollock, Vande Sande & Priddy

[57] ABSTRACT

A mounting arrangement for a recessed electrical fixture includes first and second spring supports and a locator plate to secure the first and second spring supports to the fixture. Each of the spring supports includes a pair of first arms which are removably secured to the fixture via the locator plate. The spring supports further include a pair of springs for biasing a pair of second arms to rotate relative to the first arms. The pair of second arms are joined at an end opposite the springs in a support contacting end. A fixture with the mounting arrangement as described can be inserted into an aperture in the ceiling and supported by the contact between the support contacting ends and an upper surface of the ceiling. No particular preparation for mounting, other than provision of an aperture in the ceiling, is required.

10 Claims, 3 Drawing Sheets

FIG.6A
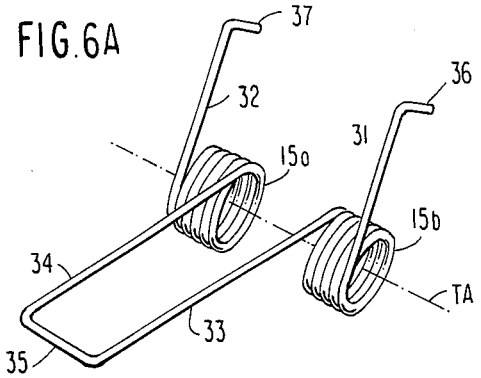
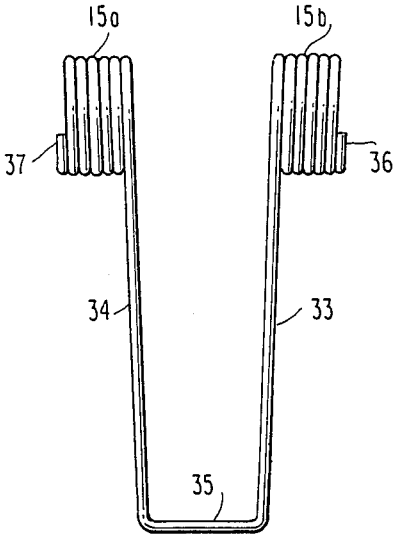
FIG.6B
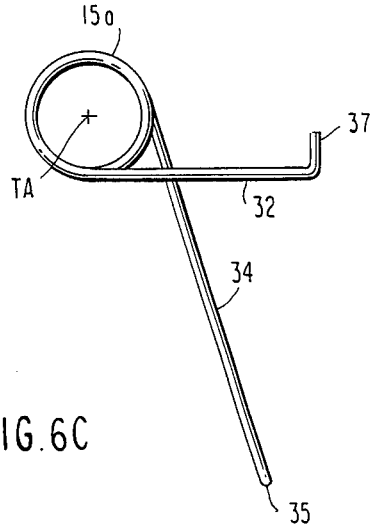
FIG.6C

SIMPLE MOUNTING FOR ELECTRICAL FIXTURE

DESCRIPTION

1. Technical Field

The invention relates to a mounting arrangement for an electrical fixture, and particularly one which allows the fixture to be mounted in a support structure without requiring any preparation of the support structure other than merely providing an aperture for the fixture.

2. Background Art

The prior art provides many and varied arrangements for mounting various devices in or adjacent some support structure. Mounting electrical fixtures in a support structure such as a ceiling carries a requirement which differentiates the mounting arrangement for electrical fixtures from mounting most other items in that, once mounted, the fixture must be removable. Removability is certainly required for replacement of the fixture and may be required at more frequent intervals for maintenance purposes.

The prior art has provided techniques which allow for removability of electrical fixtures. One class of such mounting arrangements merely uses an attachment such as a screw which is threaded through a mounting plate attached to the fixture and then driven into the support such as the ceiling. Functionally this arrangement could be considered practical but aesthetically it leaves much to be desired.

In an attempt to overcome this aesthetic appearance, other arrangements have been devised and put into actual use. U.S. Pat. Nos. 2,997,575; 4,399,497 and 4,471,416 show one particular mounting arrangement applied to light fixtures and U.S. Pat. No. 3,912,865 shows a similar arrangement applied to loudspeakers. Although the arrangement described in the aforementioned patent does overcome any aesthetic defect, it does require the installer to mount a supporting arrangement either to the ceiling or more typically to framing members or beams supporting the ceiling.

It is an object of the invention to provide a mounting arrangement which has the capability of removability, does not have a negative appearance and at the same time does not require peripheral or auxiliary supporting apparatus. More particularly, it is an object of the invention to provide a mounting arrangement for an electrical fixture in a support structure which does not require any auxiliary apparatus attached to the support or any preparation of the support (other than provision of an aperture in the support). Examples of electrical fixtures which can be mounted in accordance with the invention are either lighting fixtures or loudspeakers.

SUMMARY OF THE INVENTION

The invention meets these and other objects in providing a simple, inexpensive mounting arrangement which minimizes the preparation of the support structure and does away with the necessity for auxiliary or peripheral apparatus. A locator plate is attached to the fixture to be supported. The locator plate has a plurality of apertures therein. The locator plate is attached to the fixture for the purpose of securing a pair of spring means to the fixture. Thus the spring means are interposed between the surface of the fixture and the locator plate, so that when the locator plate is secured to the fixture it secures the spring means to the fixture as well.

The spring means include a pair of arms separated by a spring; the spring tends to bias one of the arms to rotate relative to the other arm. One of the arms of the spring means is secured between the locator plate and the fixture and in that condition the second arm is biased to rotate toward the fixture through the action of the spring which is a part of the spring means. An end of the second arm spaced from the spring has a support contacting end. The length of the second arm is adjusted, relative to the height of the fixture so that with the fixture installed in a support such as a ceiling, the support contacting end of the second arm supports the fixture in a desired position relative to the support.

A pair of spring means are supported, each including first and second arms, with the first arms of each of the springs secured to the fixture by the locator plate. The aperture in the support provided for mounting the fixture has a diameter which is greater than the fixture to be supported but sufficiently small so that when the fixture is inserted within the aperture, the second arms of each of the spring means contacts a surface of the support and thereby provides support for the fixture.

Because each of the second arms is rotatable with respect to the first arm (which itself is fixed relative to the fixture), removal of the fixture when mounted in accordance with the invention is relatively simple. A user merely pries an available surface of the fixture away from the support. That one of the second arms of the spring means closest to the portion of the fixture which is being removed from the support is thus forced to rotate against the action of the spring. As the fixture rotates out of the aperture, the user can place a finger on that one of the second arms and rotate the second arm in the direction in which it was being rotated by the support so that the second arm tends to fold or lie above the first arm. This allows the entire fixture to be removed from the aperture in the support.

Mounting the fixture is essentially the reverse of the operation just described. The fixture with the locator plate and the spring means attached is moved to a region adjacent the aperture, the user selects one of the two second arms and rotates it to tend to bring the second arm adjacent the corresponding first arm. In this condition, the other second arm can be placed through the aperture to lie on an upper surface of the support and the entire fixture rotated into the aperture. When the user removes his finger, retaining the selected second arm the second arm is caused to rotate, by the spring down toward the support. The user merely continues the rotation and the fixture is firmly seated as the second arm of each of the spring means contacts the support surface.

Accordingly, the invention provides a mounting arrangement for mounting a recessed electrical fixture in a support structure which does not require auxiliary apparatus attached to the support structure or any preparation of the support structure other than provision of an aperture in the support structure for the electrical fixture, said mounting arrangement comprising:

locator means secured to an electrical fixture for immovably securing first arms of a pair of spring means to said electrical fixture, a pair of spring means secured to said locator means, each of said spring means including first and second arms separated by a spring for biasing said second arm to rotate about an axis of said spring relative to said first arm, each of said second arms including a support contacting end means for supporting said electrical fixture relative to said support by contact with a surface of said support.

BRIEF DESCRIPTION OF THE DRAWINGS

The invention will now be further described in the following portions of this specification when taken in conjunction with the attached drawings in which like reference characters identify identical apparatus and in which:

FIGS. 6A–6C show one of the spring means; and

DETAILED DESCRIPTION OF A PREFERRED EMBODIMENT

Figure 1:
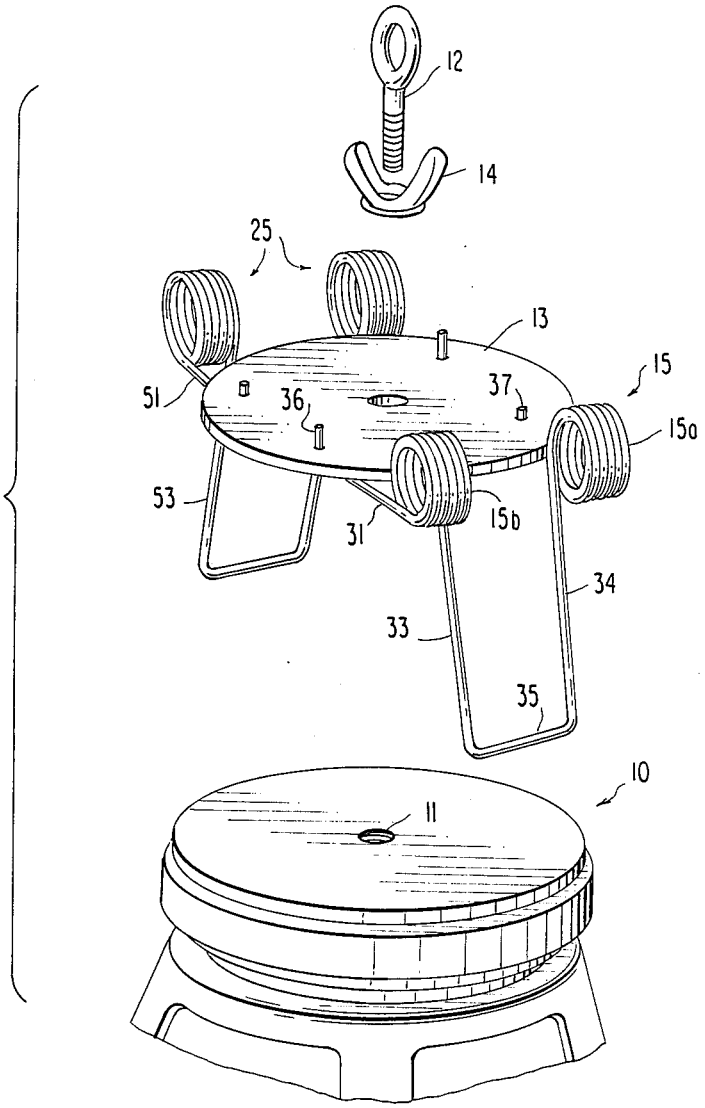
FIG. 1 is an exploded view of the mounting arrangement in accordance with the present invention shown relative to one end of a typical electrical fixture.

FIG. 1 shows at 10 one end of a typical electrical fixture which can either be a light fixture or a loudspeaker or the like. The electrical fixtures which are supported by the mounting arrangement described herein are adapted to be recessed in a ceiling. The electrical fixture is prepared for cooperation with the mounting arrangement of the invention by providing a threaded hole 11 therein.

Figure 7:
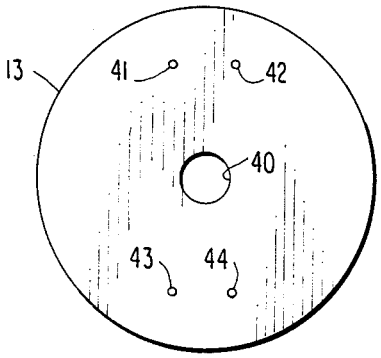
FIG. 7 shows a plan view of the locator plate.

As shown in FIGS. 1, 6 and 7 the components of the mounting arrangement include a threaded bolt 12 which is adapted to be threaded into the hole 11, a locator plate 13 having a number of apertures therein including an aperture for the bolt 11 as well as a pair of apertures for each of a pair of spring means. FIG. 1 shows a first spring means 15 and a second spring means 25. Each of the spring means includes a pair of springs; the spring means 15 includes springs 15*a* and 15*b*. Each of the spring means is formed from a single thin metal rod of suitable spring characteristics to comprise four arms, arms 31 and 32 are generally parallel to each other as are arms 33 and 34. The arms 33 and 34 are joined by a support contacting end 35. The arms 31 and 32 have upturned ends 36 and 37.

Referring more particularly to FIG. 6, a typical one of the spring means such as spring means 15 is illustrated. As shown in FIG. 6 the spring means is constructed out of a single integral wire element. The wire element has properties chosen in relation to the weight and size of the fixture to be supported. In an embodiment that has been constructed for a 2 lb loudspeaker the wire was 28 piano gauge wire with a spring rate of 0.56 rad/lb. Spring rate should increase, approximately proportionally with fixture weight. As seen in FIG. 6 the spring means has first arms 31 and 32, second arms 33 and 34 and a support contacting end 35 connecting the second arms. Arms 31 and 32 have upturned legs 36 and 37, respectively. Beginning at the upturned leg, the integral wire element comprising the spring means includes a first arm 31 which, at an end opposite the upturned leg, is coupled to an end of a spring 15*b*. The other end of the spring 15*b* is coupled to one end of a second arm 33, the other end of which is connected to one end of the support contacting end 35. The other end of the support contacting end 35 is coupled to one end of a second arm 34, the other end of which is connected to one end of the spring 15*a*. The other end of the spring 15*a* is connected to one end of a first arm 33, the other end of which is connected to the upturned leg 37. In the embodiment constructed each coil had a 0.75 inch diameter with 6 turns.

For ease of assembly, the upturned legs 36 and 37 have equal length. It is preferable that one of the first arms of each spring means has an upturned leg which is longer than the other upturned leg.

As shown in FIG. 6, the springs 15*a* and 15*b* each have an axis, which is common and that is represented in FIG. 6 by the dashed line TA. Furthermore, the support contacting end extends in the direction which is generally parallel to this axis TA.

Figure 2:
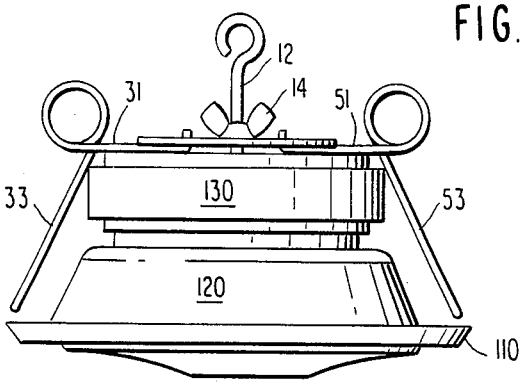
FIGS. 2, 3, 4 and 5 illustrate the mounting arrangement attached to an electrical fixture such as a loudspeaker and show in the sequence how such an electrical fixture can be inserted in an aperture in a support and removably mounted therein.

To assemble the mounting arrangement to the fixture, the first spring means 15 is arranged with its first arms 31, 32 lying below the locator plate 13 and its upturned ends 36, 37 inserted within a pair of apertures such as the apertures 41, 42 in the plate 13. The second spring means 25 is arranged in a similar fashion with its first pair of arms 51, 52 located below the plate 13 and its upturned ends within the other apertures such as the apertures 43 and 44 of the plate 13. The locator plate is then placed onto an available upper surface of the electrical fixture 10 so that the first arms of the spring means lie between the locator plate 13 and the fixture 10. The aperture 40 in the plate 13 is then aligned with the threaded hole 11 in the fixture 10. The bolt 12 is then threaded through the aperture 40 and into the threaded hole 11. The locator plate 13 is fixed to the fixture 10 by the cooperation between for example a stop on the bolt 12, with the first arms of the first and second spring means interposed between the locator plate 13 and the fixture 10. The stop on the bolt 12 can be replaced by a simple wing nut (see FIG. 2). As thus mounted, the second arms 33 and 34 (and 53, 54) are biased by the springs 15*a*, 15*b* and 25*a*, 25*b* to lie along side the fixture 10 as shown in FIG. 2. Preferably fixture 10 has a baffle plate 110 for reasons which will be described hereinafter.

Figure 3:
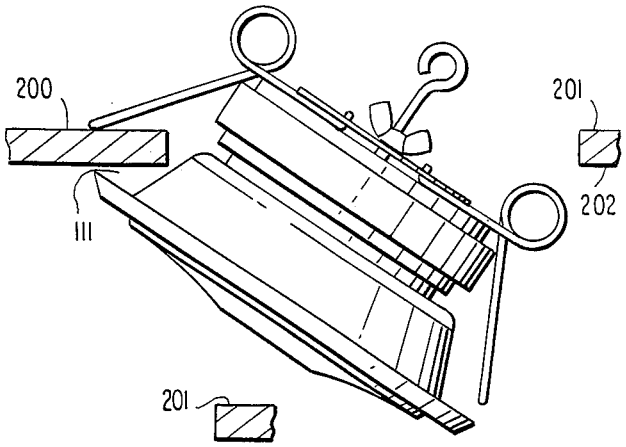
Figure 4:
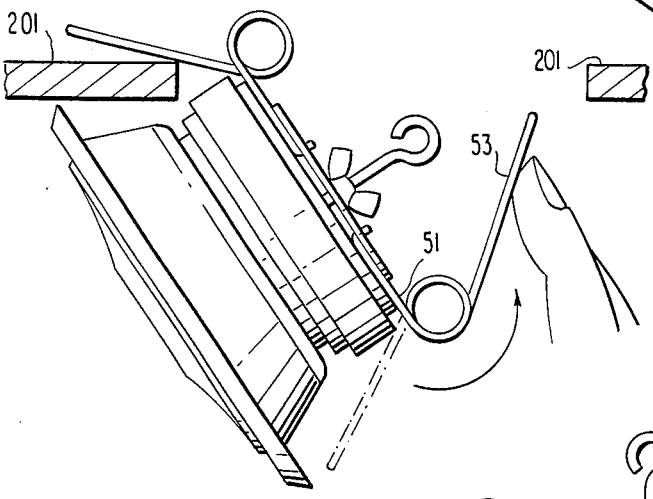
Figure 5:
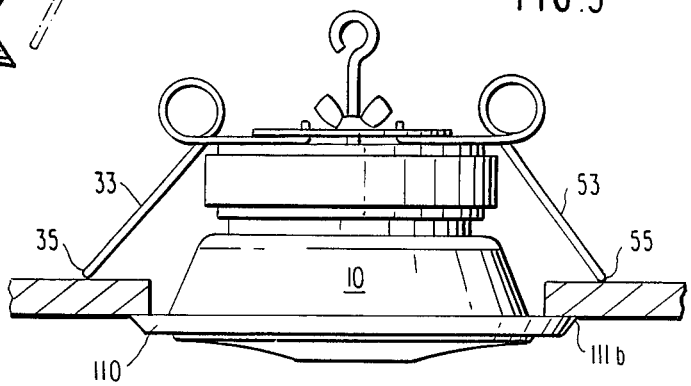

FIGS. 3–5 show a typical insertion sequence for mounting the electrical fixture 10 relative to a ceiling 200 which has been prepared for the mounting by providing an aperture therein. The aperture or hole in ceiling 200 must be larger than the speaker basket and yet must be smaller than the speaker baffle (in one embodiment, between $4\frac{3}{8}''$ and $5''$). The ceiling 200 has a surface 202 which is sometimes referred to as the lower surface and an upper surface 201 which is sometimes referred to as the supporting surface.

In the initial stages of mounting the fixture (see FIG. 3), the second arm 33 is rotated away from the fixture against the action of the spring 15 so as to allow the support contacting end 35 to lie on the upper surface 201 as shown in FIG. 3. At this point, the second arm 53 (and 54 which is not seen in FIGS. 3–5) is rotated against the action of the second spring 25 away from the side of the fixture, as is suggested in FIG. 4 by the user's finger. When the second arm 53/54 has been rotated through a sufficient angle, that portion of the fixture to which the spring means 25 is secured by the locator plate 13 can be rotated within the aperture of the support 200. The user can then merely withdraw his finger and the bias provided by the springs 15 and 25 rotate the second arms 33/34 and 53/54 toward the fixture to bring the support contacting ends 35 and 55 into contact with the upper support surface 201. This is the condition illustrated in FIG. 5. In this condition, the user can manually adjust the center line of the fixture to lie colinear with the center line of the aperture in the support 200. The flanges 111 are biased against the lower surface 202 by the force exerted from the springs 15 and 25 through the support contacting ends 35 and 55.

It should be apparent that the force provided by the spring should be selected in relation to the weight of the fixture to be supported. Furthermore, for fixtures of reasonable weight, a user can easily pry one corner, such as the corner 111*b*, away from the lower surface 202 of the support 200 to begin the removal process. The different steps in the removal process merely follows the sequence of FIGS. 5, 4 and 3, e.g. the reverse of the insertion process.

It should be apparent that many and various changes can be made without departing from the spirit and scope of the present invention. For example, the spring means can be secured to the locator plate through a different arrangement, e.g. they can be braised or welded to the plate. Furthermore, the first arms (31, 32) can be replaced by a single arm and likewise the second arms (33, 34) can be replaced by a single arm. To improve the rigidity of the mounting arrangement in the event only a single second arm is employed, the support contacting end can be widened in a variety of fashions. In one case, for example, the single second arm can join the support contacting end to form a T shape configuration.

Although one advantage of the mounting arrangement as shown in FIGS. 1–7 is that it can be removed from the fixture, it is also within the invention to fix the locator plate and the spring means to the fixture in a more permanent fashion such as by welding or the use of adhesives, etc. Pairs of locators and springs may be nested or piggy-backed to support greater loads. Alternatively the locator plate can be increased in size to support spring means with more than two springs, more than a pair of spring means, etc. Accordingly, the scope of the invention is to be construed not by the exemplary description provided herein but is to be construed in accordance with the attached claims.

I claim:

1. A mounting arrangement for mounting a recessd electrical fixture in a support structure which does not require auxiliary apparatus attached to the support structure or any preparation of the support structure other than provision of an aperture in the support structure for the electrical fixture, said mounting arrangement comprising:

locator means secured to an electrical fixture for immovably securing first arms of a pair of spring means to said electrical fixture, a pair of spring means secured to said locator means, each of said spring means including first and second arms separated by a spring for biasing said second arm to rotate about an axis of said spring relative to said first arm, each of said second arms including support contacting end means for supporting said electrical fixture relative to said support structure by contact with a surface of said support structure, wherein each said spring means comprises an integral wire element with a first arm component extending between a first upstanding leg and one end of a first spring coiled about a first theoretical axis, a second arm component extending between a second end of said first spring and a support contacting end, a further second arm component extending between said support contacting end and one end of a second spring coiled about a second theoretical axis substantially colinear with said first theoretical axis, a futher first arm component extending between a second end of said second spring and a second upstanding leg.

2. An arrangement as recited in claim 1 wherein said locator means is a substantially planar element with apertures for each of said spring means, each of said first arms including an upstanding leg inserted into one of said apertures, means securing said locator means to a surface of said electrical fixture with said first arms located between said electrical fixture and said planar element.

3. An arrangement as recited in claim 1 wherein said first and second upstanding legs have an equal length.

4. An arrangement as recited in claim 1 wherein said first and second upstanding legs of said spring means have unequal lengths, said first upstanding legs of said spring means have an equal length which is different from lengths of the second upstanding legs of said spring means.

5. An arrangement as recited in claim 1 wherein said support contacting end extends between said second arm component and said further second arm component in a direction which is generally parallel to said theoretical axis of said first and second springs, for contact with said support structure.

6. An arrangement for removably mounting a recessed electrical fixture in a support structure which does not require auxiliary apparatus attached to the support structure or any preparation of the support structure other than provision of an aperture in the support structure for the electrical fixture, said mounting arrangment comprising:

a generally planar plate with at least four apertures therein, a pair of supports, each an integral wire including a first arm component with an upturned end at one extremity and merged into an end of a first coil spring at another extremity, a second arm component merged into another end of said first coil spring at one extremity and merged into a support contacting end at another extremity, said support contacting end merged into a further second arm component at an end opposite said second arm component, said further second arm component lying generally parallel to said second arm component and merged into one end of a further coil spring, another end of said further coil spring merged into a further first arm component lying generally parallel to said first arm component and having a free, upturned end, each upturned end located in one of said four apertures, means for securing said plate to said fixture with said first and further arm components of both supports located between said plate and said fixture.

7. An arrangement as recited in claim 6 wherein said means for securing comprises a threaded bolt and a mating threaded hole in said fixture.

8. An arrangement as recited in claim 7 which further includes a wing nut threadedly secured on said bolt in contact with a surface of said plate not in contact with said first arm component and said further first arm component.

9. An arrangement as recited in claim 6 wherein said coil springs bias said second arm components to rotate about axes which are generally parallel.

10. An arrangement as recited in claim 6 wherein said coil spring and further coil spring have axes which are generally parallel to each other.

* * * * *